US005730658A

United States Patent [19]

Kurtz et al.

[11] Patent Number: 5,730,658

[45] Date of Patent: Mar. 24, 1998

[54] GOLF SCORING DEVICE

[76] Inventors: John G. Kurtz, 102 Hoffman Rd., Rochester, N.Y. 14622; Edward L. Zabelny, 198 Bayway Dr., Webster, N.Y. 14580

[21] Appl. No.: 730,032

[22] Filed: Oct. 15, 1996

[51] Int. Cl.[6] ..... A63B 57/00; A63B 71/06

[52] U.S. Cl. ..... 473/205; 2/161.2; 116/223; 235/1 B; 235/1 C; 273/DIG. 26; 273/DIG. 30

[58] Field of Search ..... 473/205; 273/DIG. 26, 273/DIG. 30; 235/1 B, 1 C; 116/222, 223; 2/160, 161.1, 161.2

[56] References Cited

U.S. PATENT DOCUMENTS

| | | | |
|---|---|---|---|
| D. 205,077 | 6/1966 | Green | D34/5 |
| 3,124,806 | 3/1964 | Campbell et al. | 2/160 |
| 3,847,110 | 11/1974 | Inoue | 116/223 |
| 4,489,444 | 12/1984 | Graham | 2/160 |
| 4,766,611 | 8/1988 | Kim | 2/160 |
| 4,922,850 | 5/1990 | Conley | 116/222 |
| 4,998,726 | 3/1991 | Budnick | 116/223 X |
| 5,117,508 | 6/1992 | Gunter | 2/160 |
| 5,353,439 | 10/1994 | Kurtz et al. | 2/160 |

*Primary Examiner*—William H. Grieb
*Attorney, Agent, or Firm*—Frank A. Lukasik

[57] ABSTRACT

A system for attaching a scoring display unit to a fastening band of a glove. The fastening band includes a top strap, and a back surface patch for the top strap. Confronting surfaces of the top strap and the back surface patch comprise cooperating interengaging means, such as hooks and loops of VELCRO fabric. The scoring device of the invention includes a rotary, numbered disc scoring device having protrusions around the periphery which are engaged by a finger to rotate the disc as each golf shot is taken. A scoring window in the front side permits viewing of the selected score number. A fabric hook strip is attached on each end of the scoring device, the unit is placed on the top side of the top strap, wrapped under the glove flap and the hook strip engages the loop fabric of the glove strap. The assembly is then placed over the top of a glove top strap and fastened to the loop VELCRO on the underside of the glove top strap.

1 Claim, 6 Drawing Sheets

GOLF SCORING DEVICE

BACKGROUND OF THE INVENTION

1. Field of the Invention

This invention relates to a golf scoring device and more particularly to a system for attaching a golf scoring device to a glove, especially a golf glove to which the scoring device is securely fastened, yet easily removable.

2. Description of the Prior Art

Gloves used for sporting activities, such as golf gloves, include a fastening band comprised of top and bottom straps having confronting surfaces, such top and bottom straps typically being held together by the use of fabric hooks on one of the confronting surfaces, and fabric loops on another of such surfaces. Such fabric hooks and loops are currently available under the Trademark VELCRO.

Heretofore, devices and items of wearing apparel have been developed for holding golf accessories such as ball markers, watches, and tees. For example, U.S. Pat. No. 4,489,444 teaches a golf ball marker holder wherein the golfer wearing the glove may place a marker underneath the flap with the marker spike extending through an aperture through the flap and then the flap is folded down upon a pad where it is held in place.

U.S. Pat. No. 4,766,611 discloses a golf glove and watch combination that uses a conventional golf glove without modification. The watch strap feeds through retaining slots on the watch case and has VELCRO hooks on its surface facing away from the watch case. The strap extends partly around the glove flap so that the ends of the strap engage VELCRO loops on the underside of the flap. When the flap is pressed against a mating VELCRO pad, the watch is held securely in place.

U.S. Pat. No. 5,117,508 discloses a system for attaching a display unit to a glove including a first strap portion extending from the display unit and having an end region for insertion between the top and bottom straps of the glove and beneath the display unit. A second strap portion extends from an opposite side of the display unit and away from the display unit. A tack securing arrangement secures the second strap portion to the glove.

A typical golf scoring indicator is shown in U.S. Design Pat. No. 205,077, which discloses score indicator beads sliding on a thread, the beads being held in place by depressions in the scoring board.

U.S. Pat. No. 3,124,806 discloses a golf training device having a pocket stitched on the glove to hold a weight which may be inserted therein. In another embodiment, a plurality of tubular compartments contain weights in the form of spheres.

U.S. Pat. No. 5,353,439 issued to the Applicant discloses a golf scoring device consisting of a flexible plastic strip and plastic beads connected thereto and together by a linkage of nylon thread. A second embodiment includes a rotary, numbered disc scoring device which may also be affixed directly to the glove tab.

Numerous types of golf scoring devices are available to assist the golfer in recording the scored stroke by stroke, until the hole is completed and the hole score is recorded on the score card. Such devices include the type shown in Design Pat. No. 205,077, rotary dial counters, and a string of beads, for example. These devices are usually mounted on the handle of a golf cart, attached to a belt, or pinned to a golfer's clothing. Thus a player will often have to fumble about in trying to locate the scoring device right at a time when other players are waiting. The string of beads scorer is generally not used by male players and is generally used primarily by beginner golfers who have more strokes to remember. If a scoring device was devised to be both inconspicuous and readily available to the player as each stroke is made, more players, including the low scorers may also be interested in such a device.

SUMMARY OF THE INVENTION

Accordingly, it is an object of the invention to provide a system allowing a golfer to wear a scoring device on his or her wrist without having the scorer interfere with the golfer's swing.

It is another object of the invention to provide such a structure in the form of a scoring device attached to a glove in which the scoring device is securely fastened to the glove, yet is readily removable for use with another glove.

It is yet another object of the invention to provide a miniature attachable scoring device consisting of an indicator dial.

The foregoing objects are realized by the present invention in a system for attaching a scoring display unit to a fastening band of a glove. The fastening band includes a top strap, and a back surface patch for underlying the top strap. Confronting surfaces of the top strap and the back surface patch comprise cooperating interengaging means, such as hooks and loops of VELCRO fabric. The scoring device of the invention is affixed to a strip of plastic and then cemented to a strip of hook VELCRO. The assembly is then placed over the top of a glove top strap of a glove and fastened to the loop VELCRO on the underside of the glove top strap.

BRIEF DESCRIPTION OF THE DRAWINGS

The foregoing and further objects of the invention will become apparent from reading the following detailed description of preferred embodiments of the invention, in which.

DETAILED DESCRIPTION OF THE INVENTION

Figure 1:
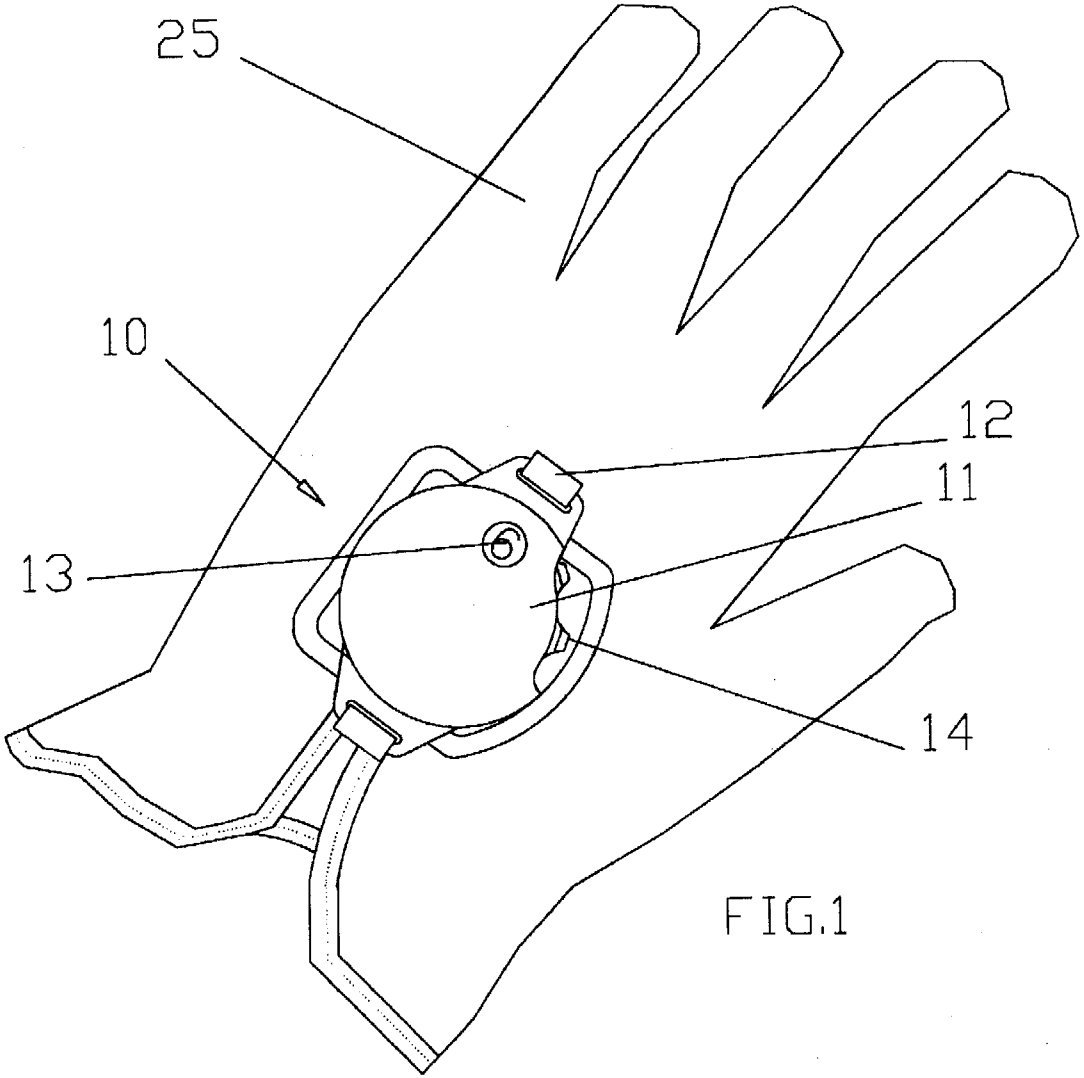
FIG. 1 is a top perspective view of a typical golf glove upon which a scoring device is mounted in accordance with the invention.
Figure 2:
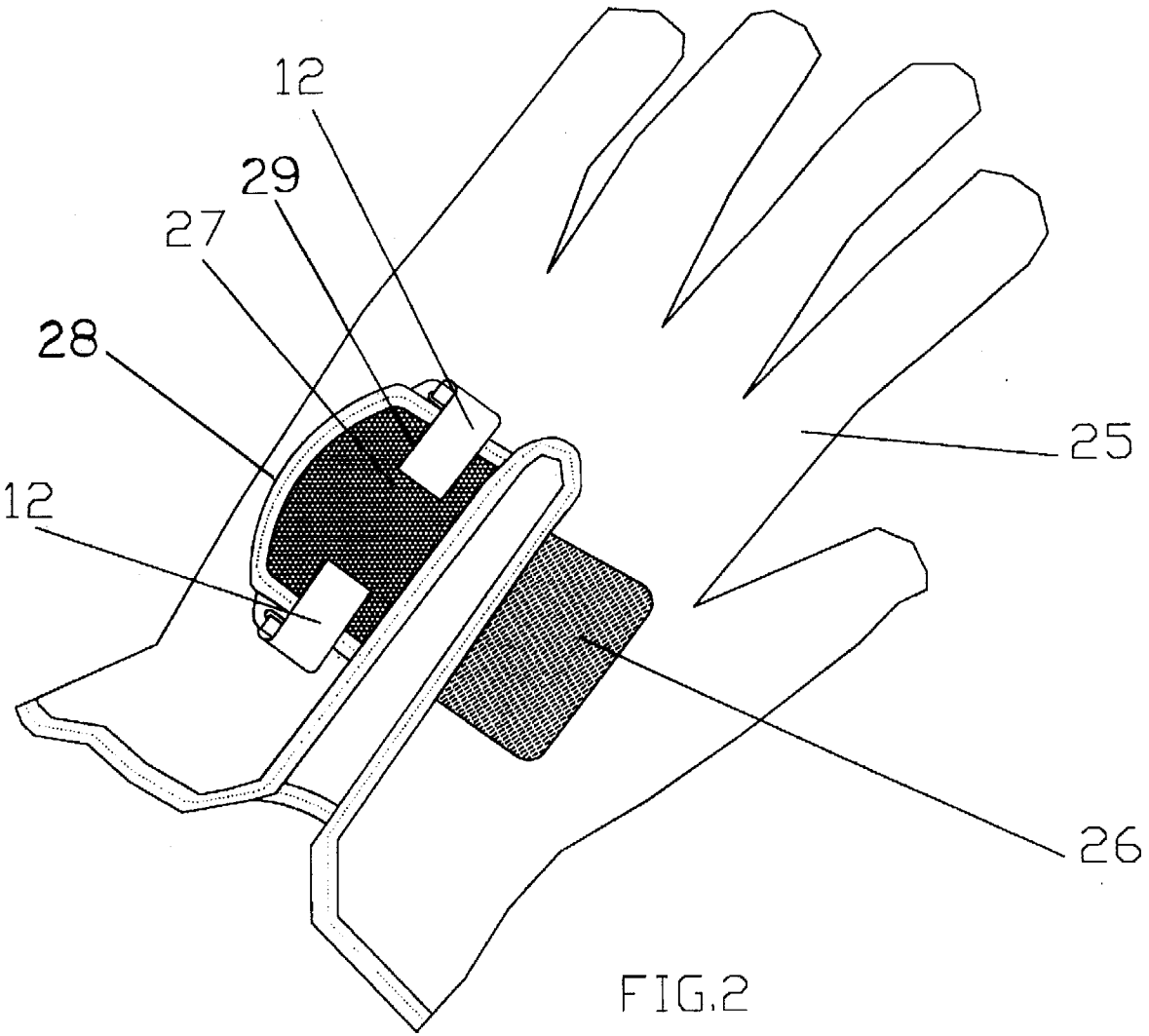
FIG. 2 is a perspective view of a golf scoring device fastened to a glove flap in accordance with the invention.
Figure 5:
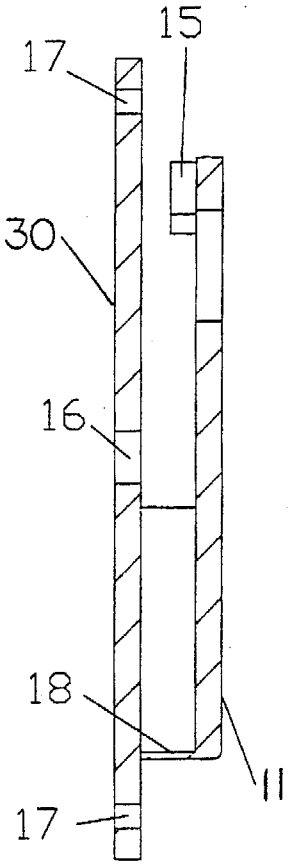
FIG. 5 is a sectional view of the base along the lines B—B of FIG. 3.

Turning now to the drawings, more particularly to FIGS. 1–7, there is shown a golf glove 25 and golf scoring device 10 in accordance with the invention. The golf glove 25, except for the golf scoring device 10 and its associated structure for incorporating it into the golf glove 25, is of conventional structure. A top strap 29 on the glove 25 (FIG. 2) has a VELCRO loop fabric underside 27. A mating layer of VELCRO hooks 26 is provided on the glove 25 beneath the top strap 28. The two mating VELCRO layers 26 and 27 serve to fasten the glove 25 around a user's wrist. FIG. 2 shows top strap 28 disengaged from hooks 26.

FIG. 2 shows the underside of top strap 28 with the strap 12 of the golf scoring device 10 of the invention. The strap 12 is shown in FIG. 1 as being threaded, hook down, through slot 17 at a first end, under the base back 30, up through slot 17 at a second end of the strap 12, and adjusted for equal protrusion beyond the slots at either end of the scoring device 10. Strap 12 then extends partly around top strap 28 of the glove 10, so that the ends of the straps 12 engage VELCRO loop fabric underside 27 of the strap 28. The strap 12, has VELCRO hooks 29 on its surface facing away from the scoring device 10. With this form of the strap 12, the VELCRO hooks 29 engage the loops 27 of top strap 28 when wrapped around the glove strap 28. This structure provides a secure attachment of the strap 12, top glove strap 28, and the golf glove 25 together.

Figure 3:
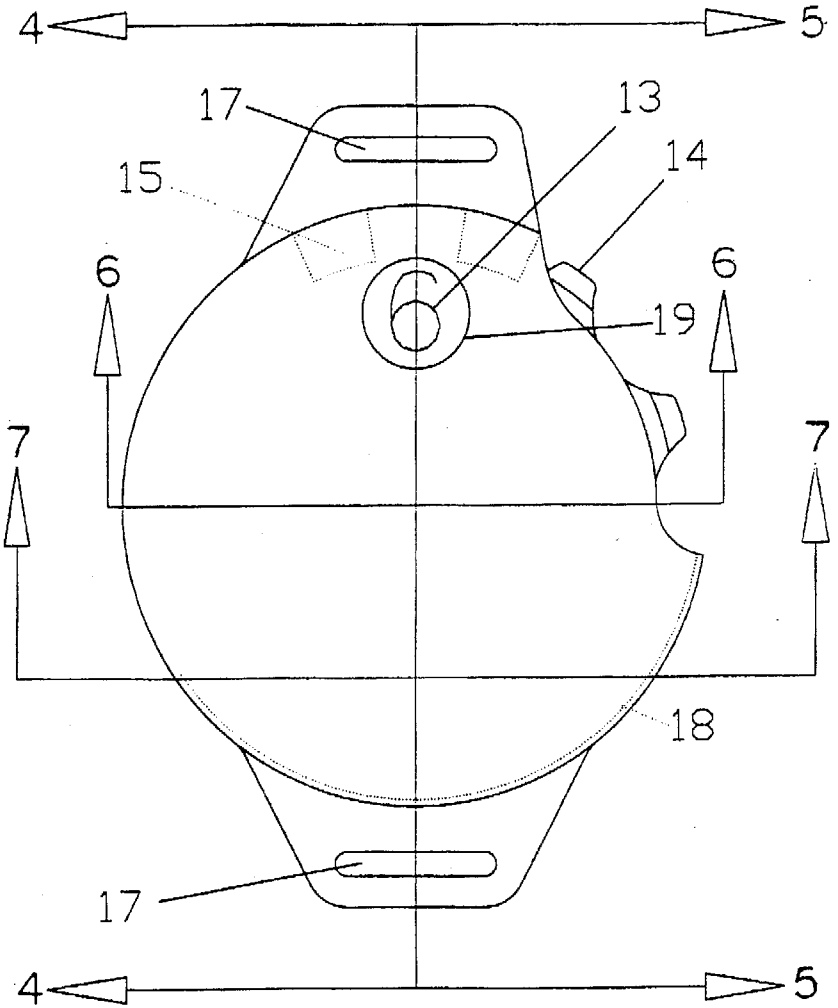
FIG. 3 is a top view of the assembled scoring device of the invention.
Figure 4:
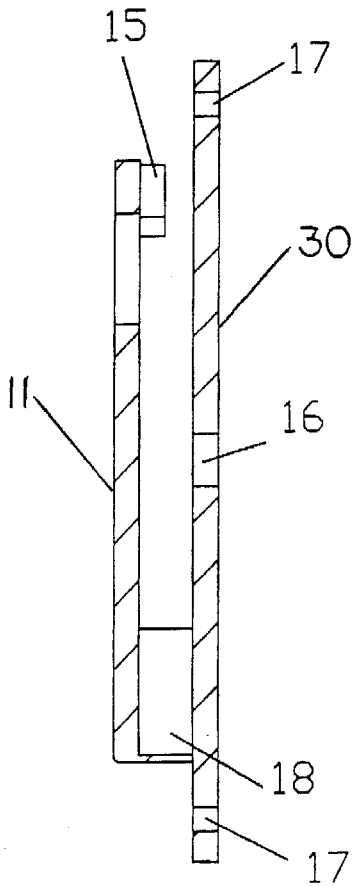
FIG. 4 is a sectional view of the base along the lines A—A of FIG. 3.
Figure 6:
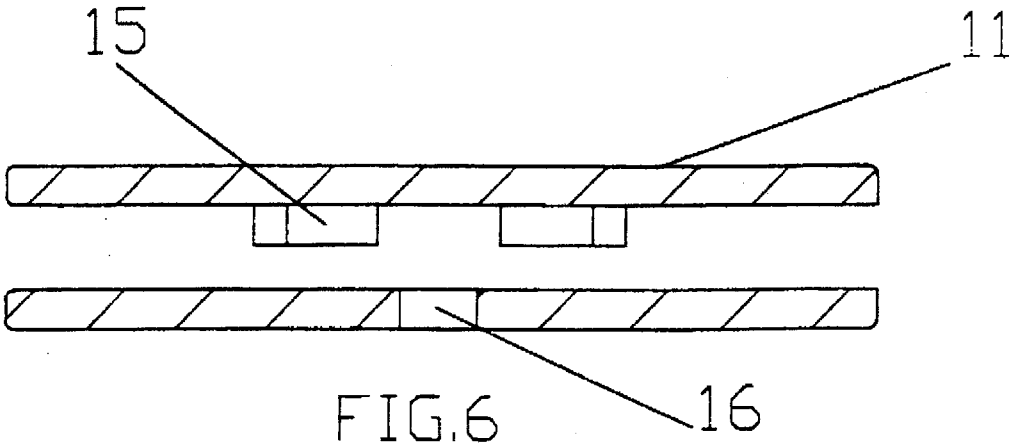
FIG. 6 is a sectional view of the base along the lines D—D of FIG. 3.
Figure 7:
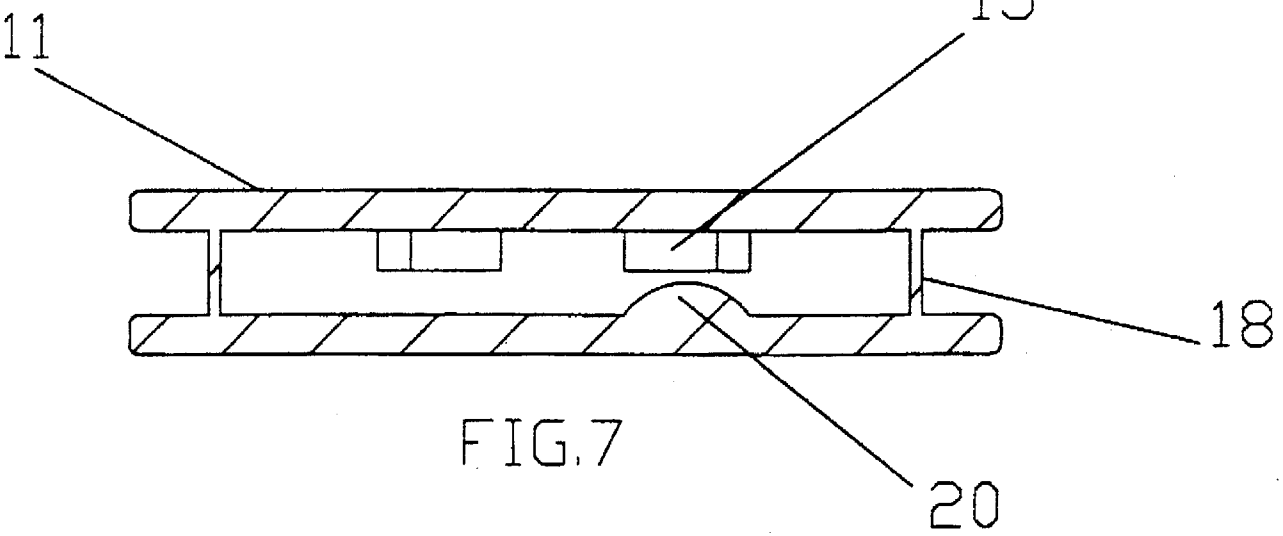
FIG. 7 is a sectional view of the base along the lines C—C of FIG. 3.
Figure 9:
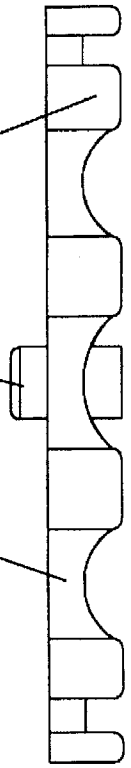
FIG. 9 is a side view of the dial disc of the invention.
Figure 8:
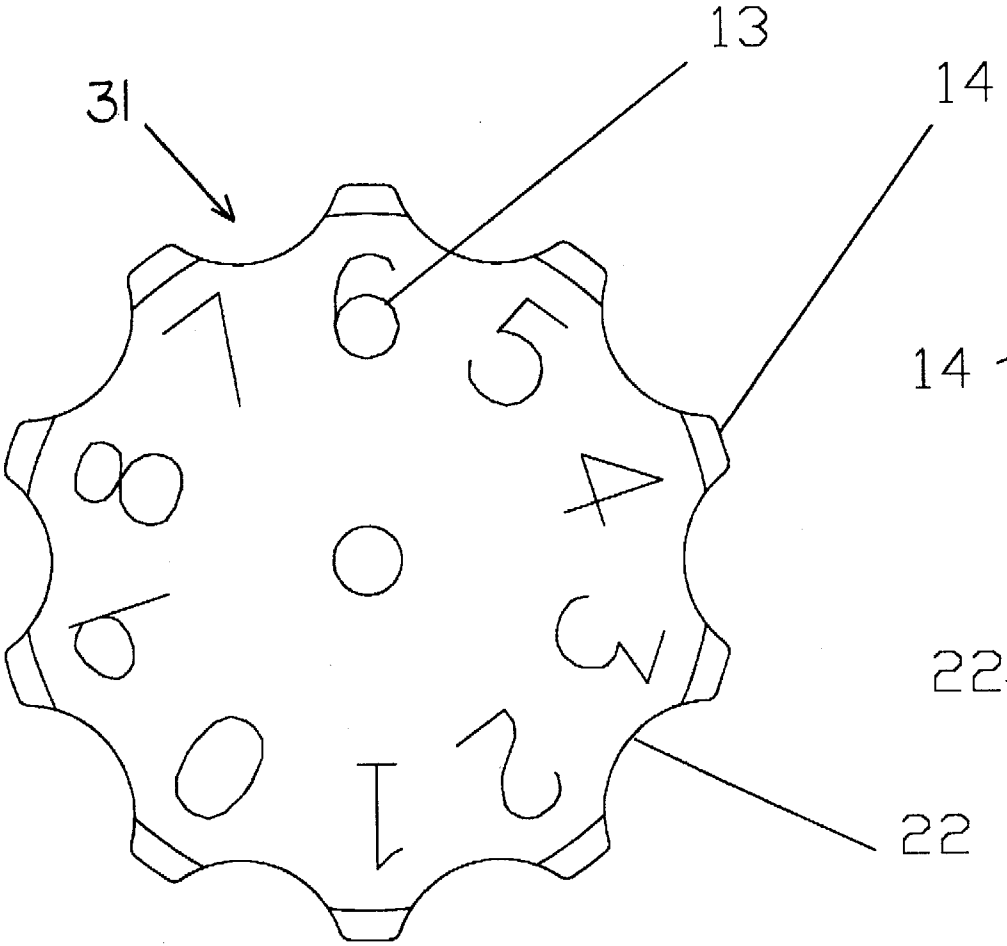
FIG. 8 is a top plan view of the dial disc of the invention.

FIG. 3 is a top view of a rotary golf scoring device 10 which comprises a base front 11, base end 18, and base back side 30. The three basic parts 11, 18, and 30, may be molded in one part or base front 11 with base end 18 may be molded in one part and then joined with back side 30 by sonic welding.

The rotary scoring device 10 comprises a rotary numbered dial disc 31 held in place and rotating on a short lug 21 pivotally mounted in hole 16 in the center of base back 30. The dial disc 31 is assembled between the base front 11 and the back side 30 by deflecting the base front 11 to slip dial disc 31 between the two parts until the lug 21 engages the hole 16 of base back 30. Base front 11 contains two tabs 15 to lock dial disc 31 in selected positions.

The dial disc 31 contains protrusions 14 around the periphery which are engaged by a finger to rotate the disc 31. Tabs 15, of base front 11, engage notches 22 as the dial disc 31 is rotated to record a stroke. As the disc 31 is rotated to position a number 13 corresponding to a stroke, the base front 11 flexes upwardly and permits the dial disc 31 to index one space to the next stroke to be indicated by numbers 13.

Figure 10:
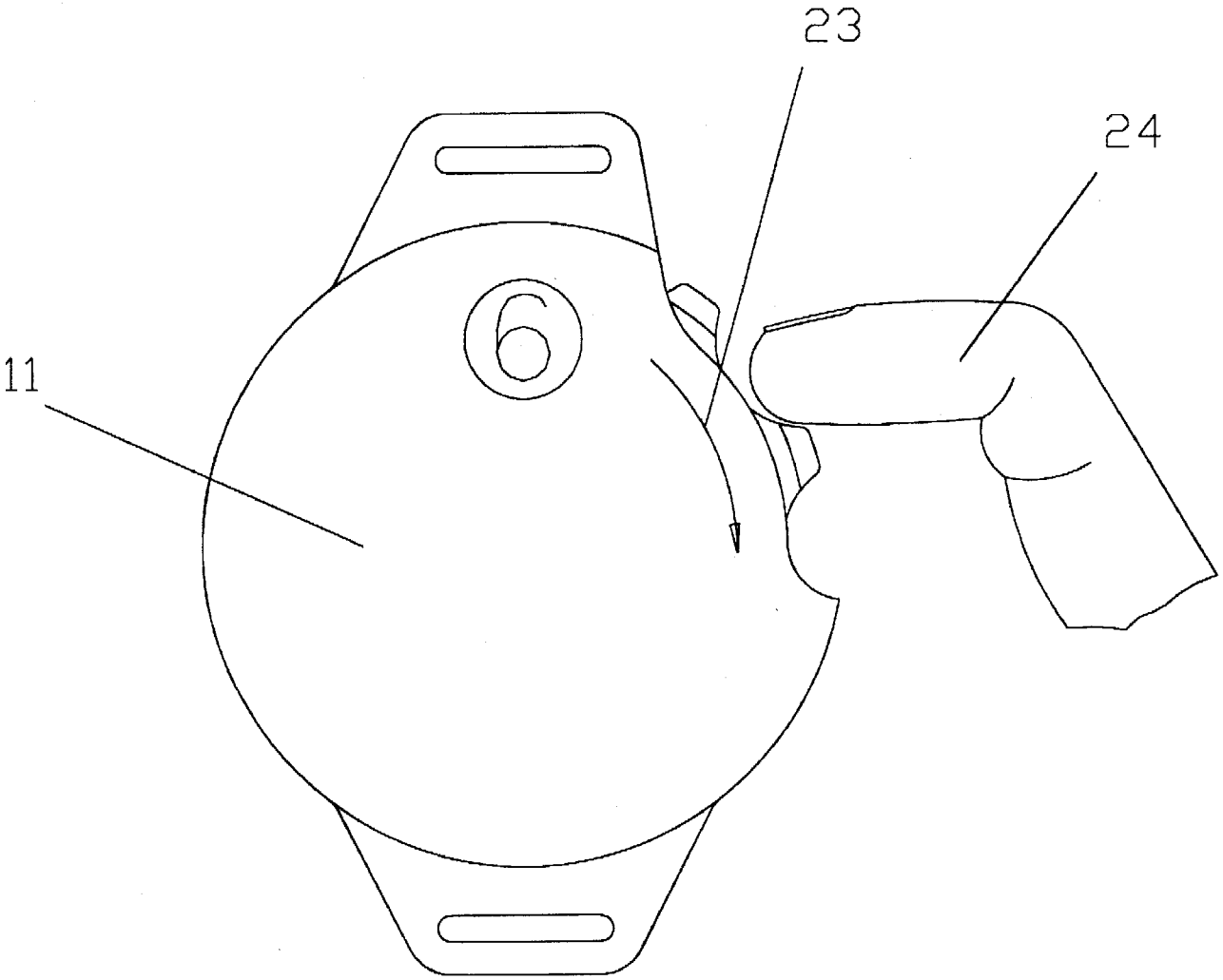
FIG. 10 is a top plan view of the scoring device being indexed to the next number.

The protrusions 14 are moved with the fingertip as shown in FIG. 10. As each stroke is taken, the golfer moves the disc 31 in the direction shown by arrow 23 until the disc 31 is held in place by tab 15. When the hole is completed, the number shown in scoring window 19 pertaining to the number of strokes taken is recorded on the golfer's scorecard. FIG. 10 shows the number 6 indicating six strokes taken on the hole. The disc 31 is re-indexed to "0" at the start of the next hole.

Thus a scoring device has been described that may be conveniently, detachably assembled to the strap of a golf glove without adding hindering weight or physical size which would be distracting visually or physically. A fingertip of the other hand is used to turn a disc from its resting position after each stroke. As an independent unit, this scoring device is easily transferable from a worn out glove to a new replacement glove using the VELCRO attaching means.

Although other means of indexing and attachment are possible, the disc of this invention tends to stay in place irregardless of any glove movement or shock. It should be understood, however, that the invention has been illustrated only in one specific form. Many modifications, additions, and deletions may be made thereto without departure from the scope of the invention as set forth in the following claims.

What is claimed is:

1. In combination, a glove, a golf scoring device, and means for attaching said scoring device to said glove, said glove having a flap joined by a first end to said glove, said flap having a loop strip affixed on the side facing said glove, said glove having a fabric hook strip affixed to said glove beneath said flap, said golf scoring device having rotary indicating means for recording each golf stroke taken on each hole, said indicating means consisting of a base having a flexible front side with a first and a second end, said second end having at least one stop tab formed thereon, a back side having a first and second end and having strap mounting slots formed at said first and second ends, and a base end, said front side having a scoring window formed near said second end and near said stop tab, a rotary, numbered, dial disc held in place and rotating around a lug mounted in said back side, said dial disc having areas for printing numbers one through zero thereon and having indexing protrusions formed therearound for engaging said stop tab to indicate the number of strokes taken by a golfer, and said means for attaching said scoring device to said glove consists of a fabric hook strip attached in each of said strap mounting slots for engaging said loop fabric of said glove.

* * * * *